US005924770A

United States Patent [19]

Tarnay et al.

[11] Patent Number: 5,924,770

[45] Date of Patent: Jul. 20, 1999

[54] CHAIR CONSTRUCTION

[75] Inventors: Matt Tarnay; Julian Vocheli, both of Torrance, Calif.

[73] Assignee: Virco Mfg. Corporation, Torrance, Calif.

[21] Appl. No.: 09/079,724

[22] Filed: May 15, 1998

[51] Int. Cl.[6] ..... A47C 3/12

[52] U.S. Cl. ..... 297/440.15; 297/446.1; 297/452.14

[58] Field of Search ..... 297/446.1, 446.2, 297/448.1, 448.2, 440.15, 440.16, 452.14, 452.15, 440.22; 403/258, 260

[56] References Cited

U.S. PATENT DOCUMENTS 3,387,887 6/1968 Jakobsen ..... 297/448.2
4,609,225 9/1986 Loucks ..... 297/452.15 X
5,080,313 1/1992 Byrum et al. ..... 403/260
5,104,192 4/1992 Gianfranchi ..... 297/440.22 X
5,123,702 6/1992 Caruso ..... 297/448.2

*Primary Examiner*—Peter R. Brown
*Attorney, Agent, or Firm*—James E. Brunton

[57] ABSTRACT

A chair construction having an integrally molded plastic shell that is interconnected with a steel supporting frame. The steel supporting frame includes a tubular supporting structure having uniquely formed upper side portions which are interconnected with the back support of the molded plastic shell using a specially designed tube end connector mechanism.

8 Claims, 10 Drawing Sheets

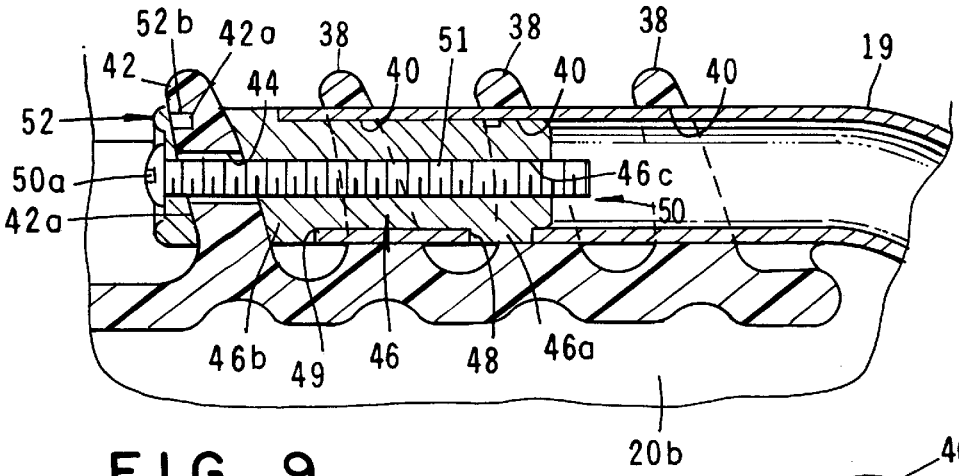
FIG. 9
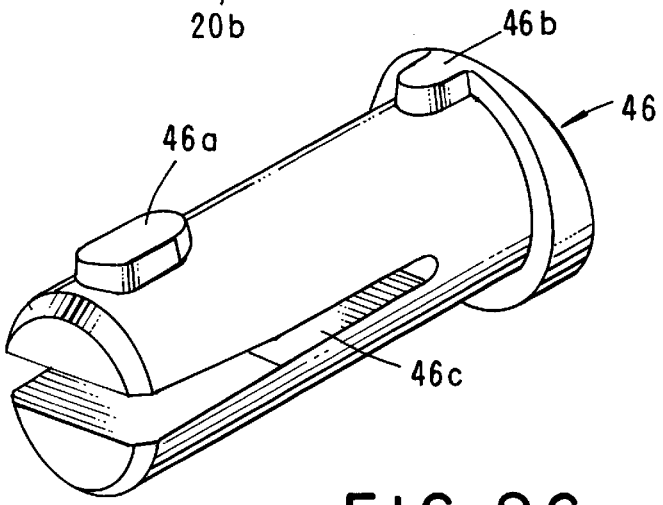
FIG. 9A
FIG. 9B
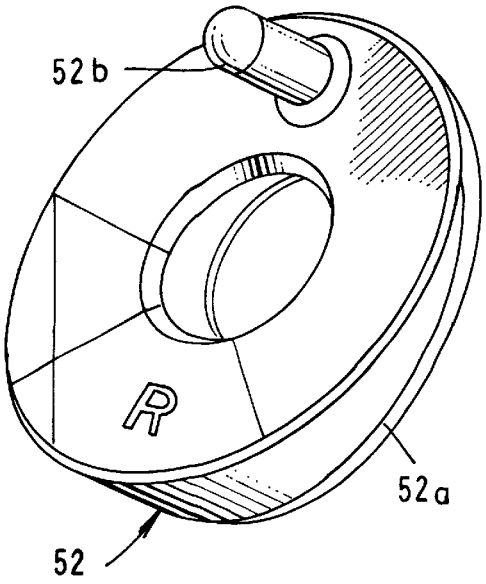
FIG. 9C
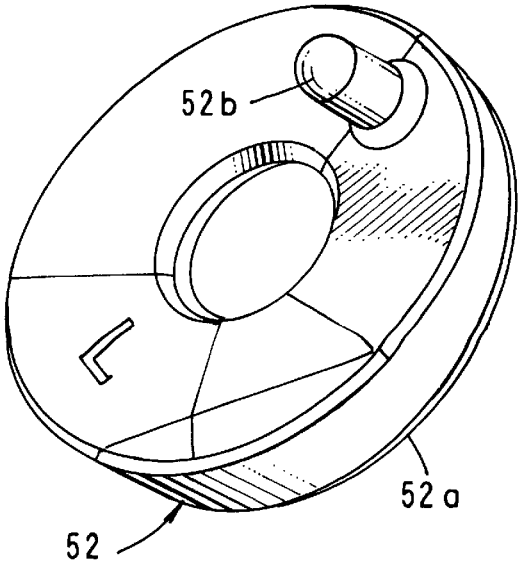

CHAIR CONSTRUCTION

BACKGROUND OF THE INVENTION

1. Field of the Invention

The present invention relates generally to furniture. More particularly, the invention concerns a chair construction having novel means for connecting of the molded plastic seat and back portions of the chair to a uniquely configured tubular supporting frame.

2. Discussion of the Prior Art

There is a growing demand for rugged, yet comfortable and attractive utility chairs of the type used in schools, auditoriums, convention centers, hotels and the like. These types of chairs are subjected to continuous and rigorous use and the impact loads frequently imposed on the chairs can often damage or destroy the structural integrity of the chairs rendering them unsafe for use. Because the prior art chairs are primarily designed for durability and cost effectiveness, the chairs are typically uncomfortable and usually quite unattractive.

With respect to the structural aspects of the prior art chairs, a particular problem exists in the manner in which the chair seat and back portions of the chair are affixed to the frame portion. As a general rule, this fixation is accomplished using rivets, screws or like connectors which, during use, have a tendency to become loosened or structurally damaged. When the seat and back portions of the utility chair are formed from a moldable plastic, the plastic on occasion, fails in the area of the connectors causing the seat or back elements to loosen or become separated from the structural frame.

The thrust of the present invention is to overcome the drawbacks of the prior art utility chairs as discussed in the preceding paragraphs by providing a uniquely constructed, highly attractive, comfortable and durable utility chair. More particularly, the invention is directed to providing a utility chair in which the seat and back portions are connected to the structural frame in a highly novel manner which permits easy and straight forward fabrication and assembly of the chair at relatively low cost.

A generally typical prior art utility chair is described in U.S. Pat. No. 4,648,653 issued to Rowland. The Rowland chair is a stacking chair having a bent rod structural support frame and a separate seat and back portions which are interconnected with the supporting frame in a traditional fashion.

Another somewhat similar prior art chair construction is disclosed in U.S. Pat. No. 2,952,300 issued to Cowen. The Cowen chair construction comprises a tubular steel support frame onto which a molded plastic shell is interconnected. The integrally molded plastic shell provides a curved back rest member, and a integrally formed seat member. The chair is supported on substantially "U" shaped tubular leg members which are secured to the molded shell by metal brackets and conventional fasteners.

U.S. Pat. No. 2,857,958 issued to Wright, discloses another common type of prior art desk chair construction. The Wright chair includes a tubular steel support frame to which seat and back portions are interconnected by rivets. A tablet arm, which includes a generally horizontally disposed tablet, is connected to one side of the tubular frame construction and extends upwardly from the seat portion of the chair.

SUMMARY OF THE INVENTION

It is an object of the present invention to provide a novel chair construction which is ideally suited for use in schools, hotels, auditoriums, convention centers and like commercial establishments.

Another object of the invention is to provide a chair of the aforementioned character in which an integrally molded plastic shell is uniquely interconnected with a rugged steel supporting frame in a manner which simplifies manufacture of the chair and at the same time produces a durable construction which can withstand continuous, normal classroom type use.

Another object of the invention is to provide a chair construction as described in the preceding paragraph in which the tubular supporting structure includes uniquely formed upper side portions which are interconnected with the back support of the molded plastic shell in a highly novel manner using a specially designed tube end connector mechanism.

Another object of the invention is to provide a method of making a chair of the class described which comprises a molded one piece shell that includes integrally molded connector tabs to which the tubular steel supporting frame of the chair is connected by means of uniquely designed connector mechanisms.

Another object of the invention is to provide a chair construction of the character described which includes a novel, upstanding tablet arm that is interconnected at one side of the tubular steel support structure.

Another object of the invention is to provide a durable and attractive utility chair and the method of making the chair which is highly cost effective so that the chair can effectively compete in the market place with prior art chairs of the same general character.

BRIEF DESCRIPTION OF THE DRAWINGS

FIG. 9 is a greatly enlarged cross-sectional view taken along lines 9—9 of FIG. 3.

FIG. 9A is an enlarged generally perspective view of the expansion plug of the connector mechanism shown in FIG. 9.

FIG. 9B is an enlarged, generally perspective view of the screw head coupler of the right connector assembly of the invention.

FIG. 9C is a generally perspective view of the screw head coupler of the left connector assembly of the invention.

DESCRIPTION OF THE INVENTION

Figure 1:
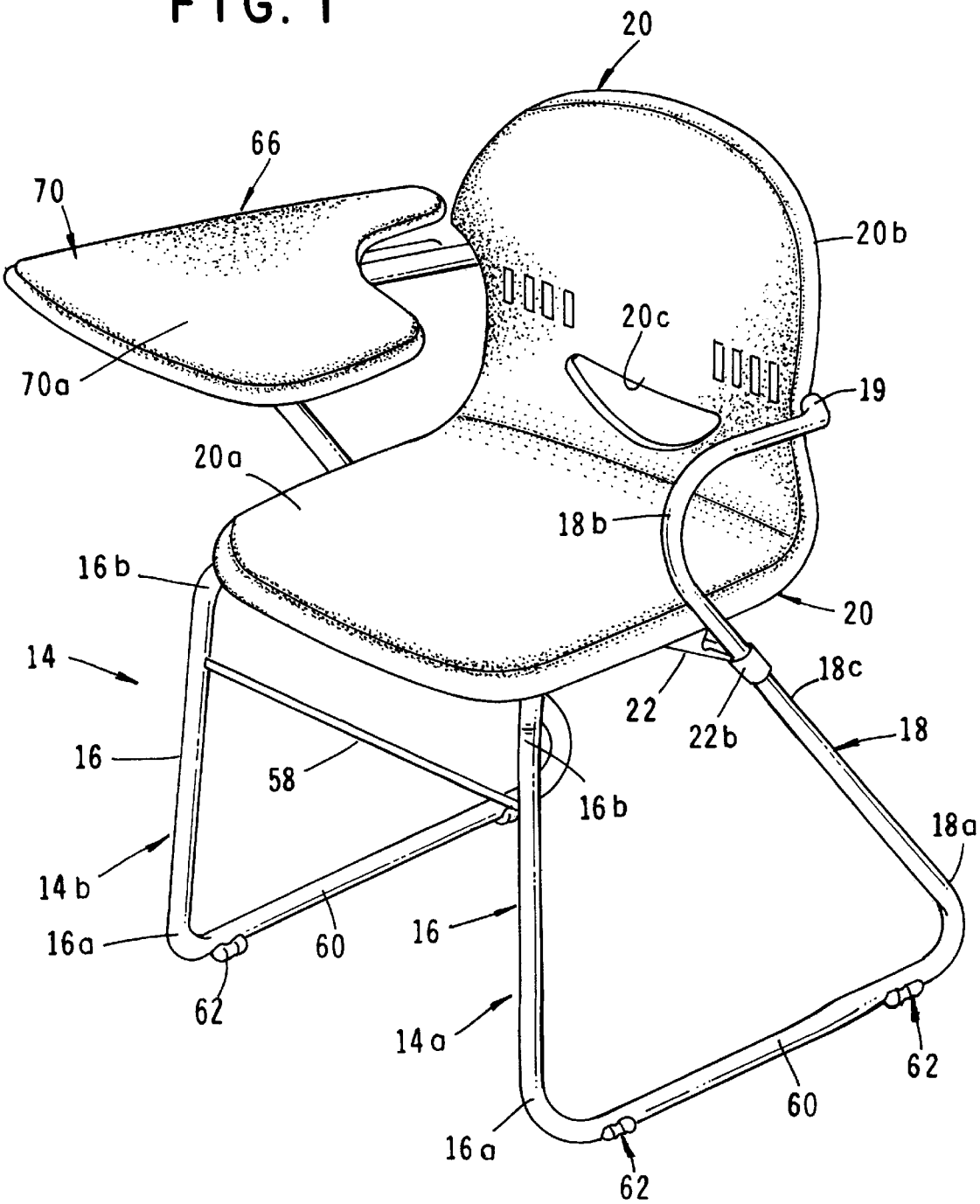
FIG. 1 is generally perspective view of one form of the utility chair construction of the present invention.
Figure 1A:
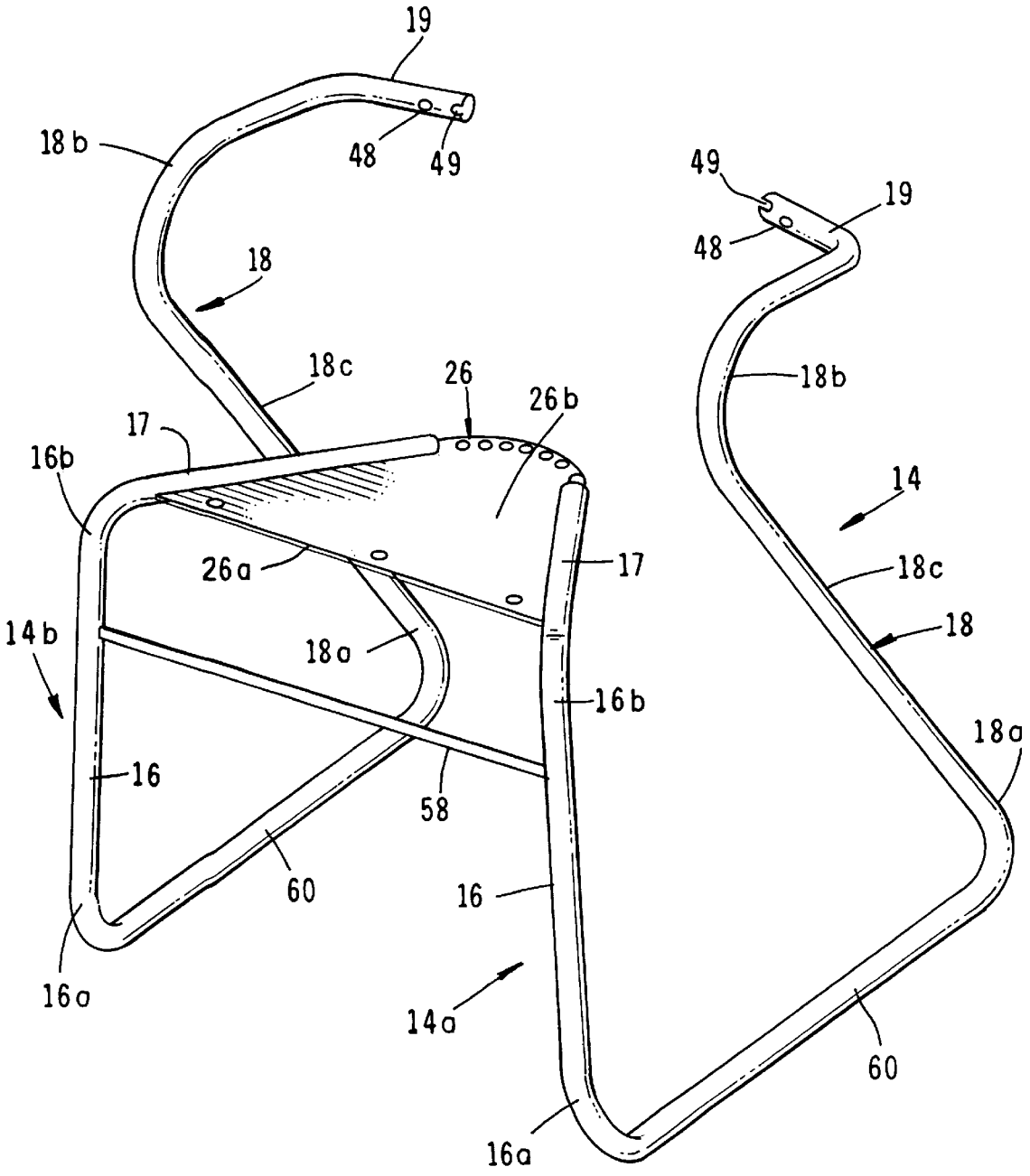
FIG. 1A is a generally perspective view of the supporting frame of the chair construction shown in FIG. 1 without the tablet arm.
Figure 1B:
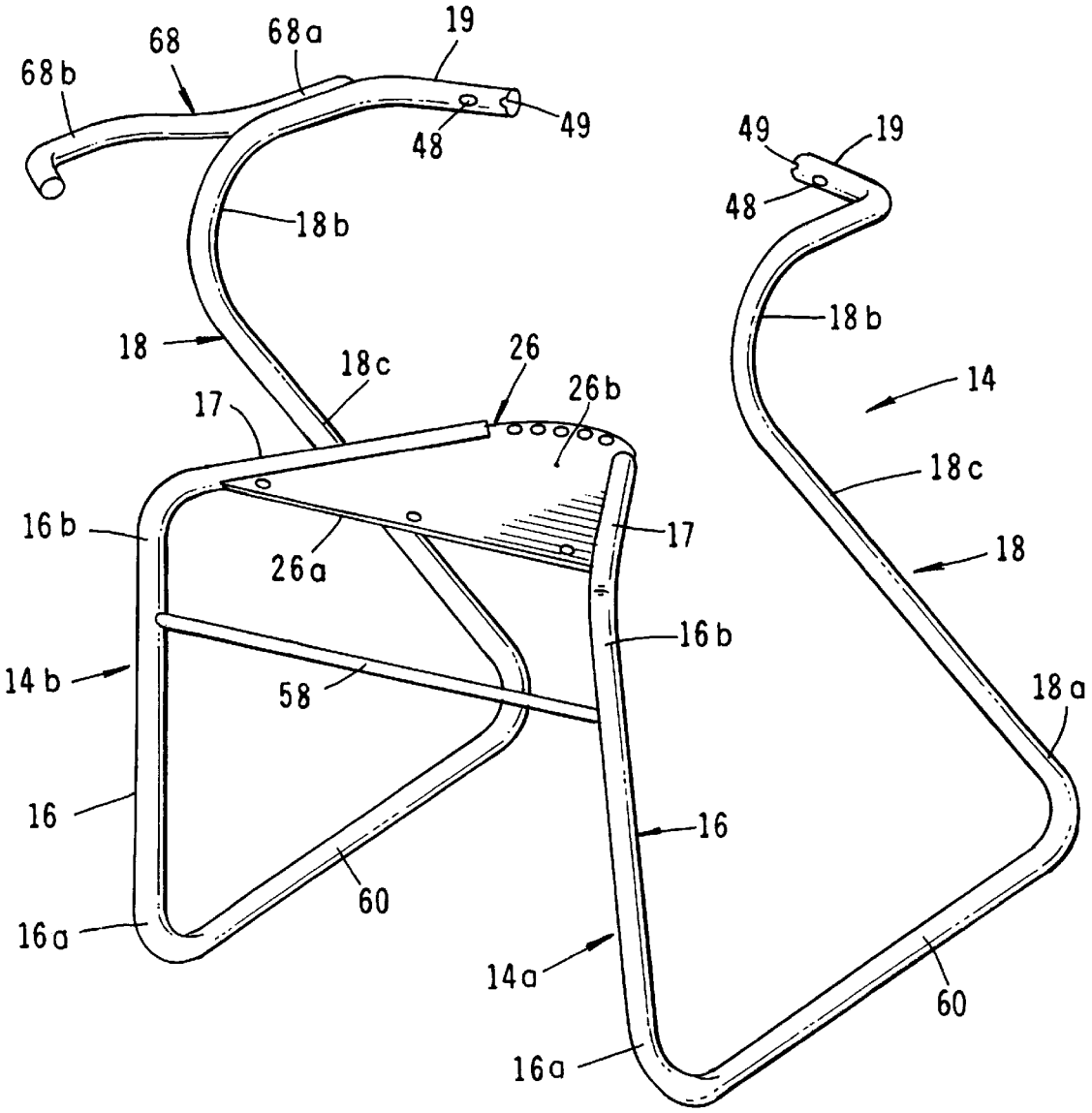
FIG. 1B is a generally perspective view of the supporting frame of the chair construction shown in FIG. 1 including the tablet supporting frame segment.

Referring to the drawings and in particularly to FIGS. 1 and 1A, one form of the chair construction of the present invention is there illustrated. As best seen in FIGS. 1A and 1B, the chair construction here comprises a supporting frame 14 having first and second sides 14*a* and 14*b* which are constructed of strategically bent metal tubing. Each of the sides 14*a* and 14*b* comprise a front leg 16 having a lower extremity 16*a* and an upper extremity 16*b*. Each upper extremity 16*b* include an inturned, rearwardly extending portion 17. Side portions 14*a* and 14*b* also include a rear leg 18 having a lower extremity 18*a* and an upper extremity 18*b*. Each of the upper extremities 18*b* includes an inturned, transversely extending portion 19 the purpose of which will presently be described. In one form of the invention, upper portions 18*b* of each side 18 comprise an arm rest which, as best seen in FIG. 1, is elevated from the seat portion 20*a* of a uniquely formed plastic molded, polypropylene shell 20, which, in a manner presently to be described, is securely interconnected with supporting frame 14 in a highly novel manner.

Figure 3:
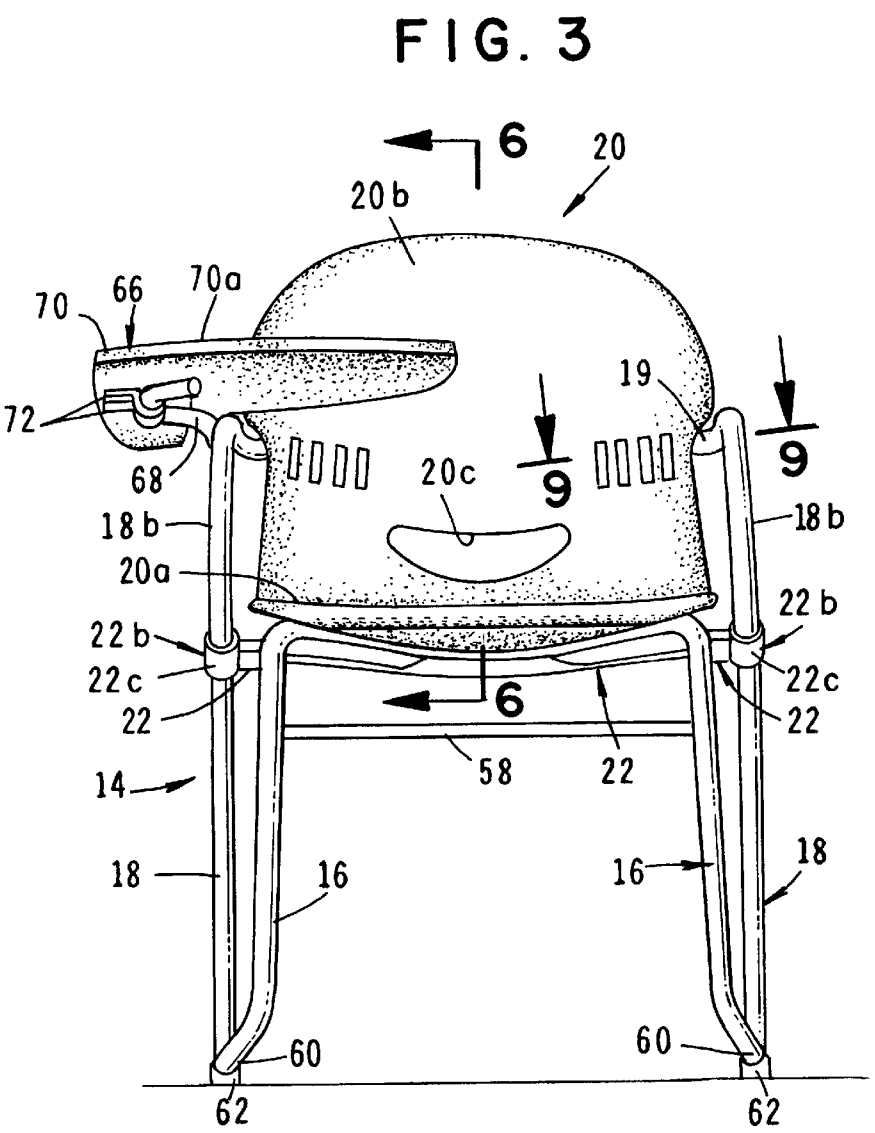
FIG. 3 is a front elevational view of the chair construction.
Figure 2:
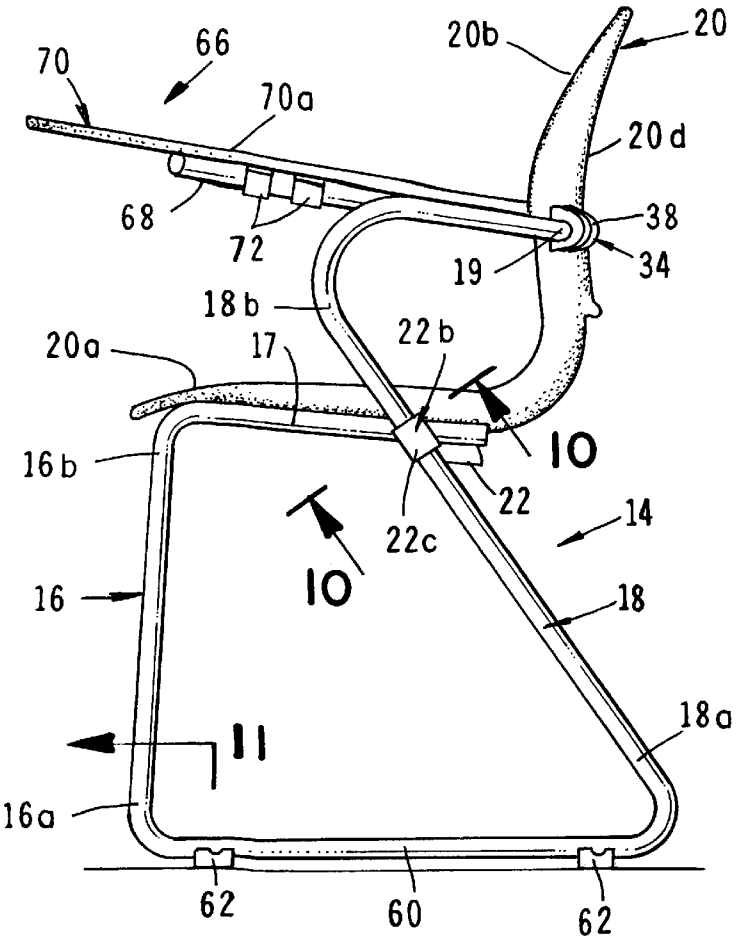
FIG. 2 is a side elevational view of the chair construction shown in FIG. 1.
Figure 5:
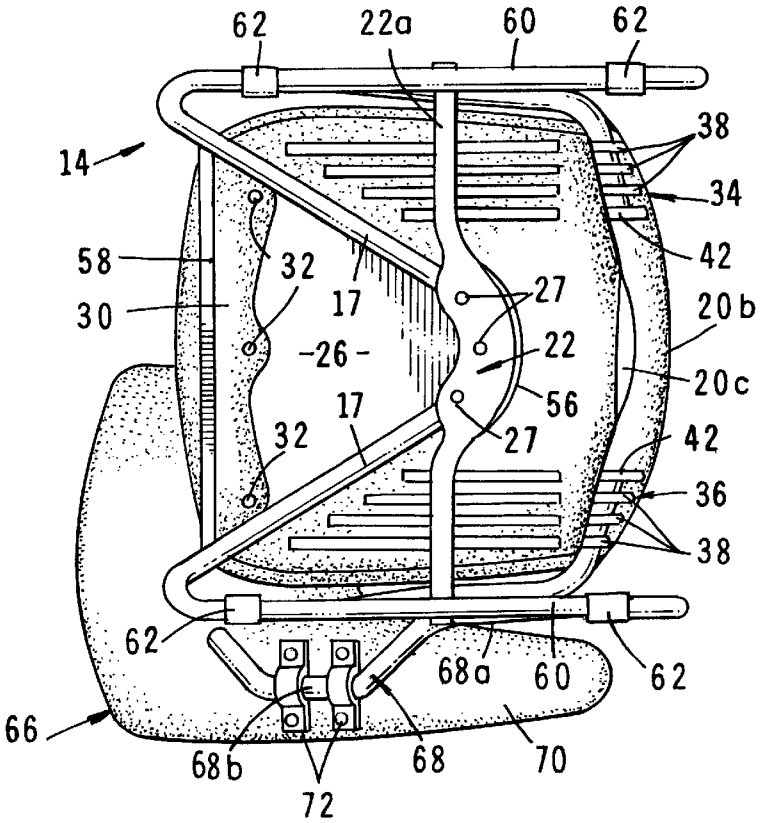
FIG. 5 is a bottom plan view of the chair construction shown in FIG. 1.
Figure 8:
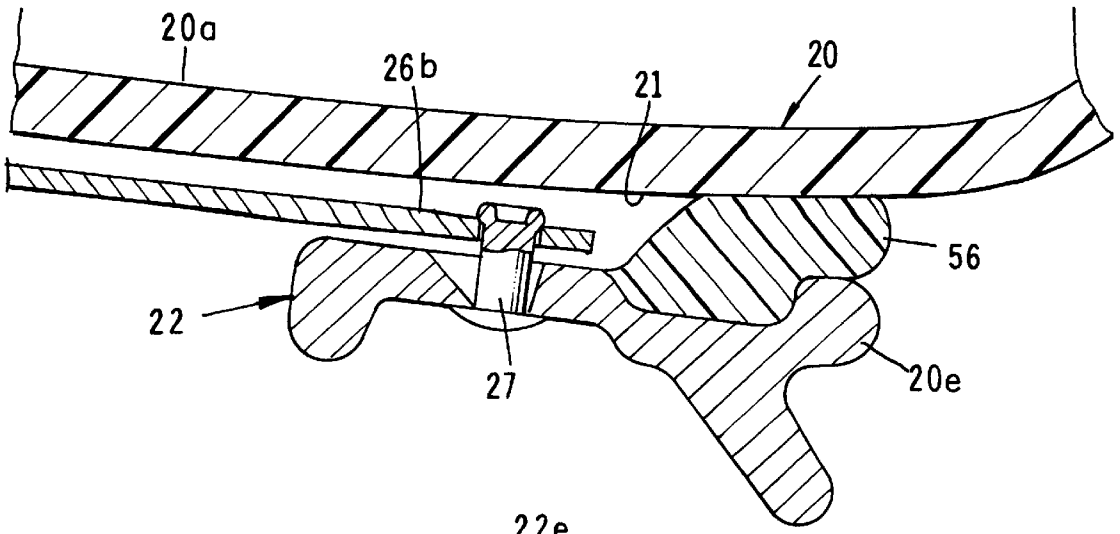
FIG. 8 is a greatly enlarged cross-sectional view of the area designated in FIG. 6 by the numerals 8—8.
Figure 8A:
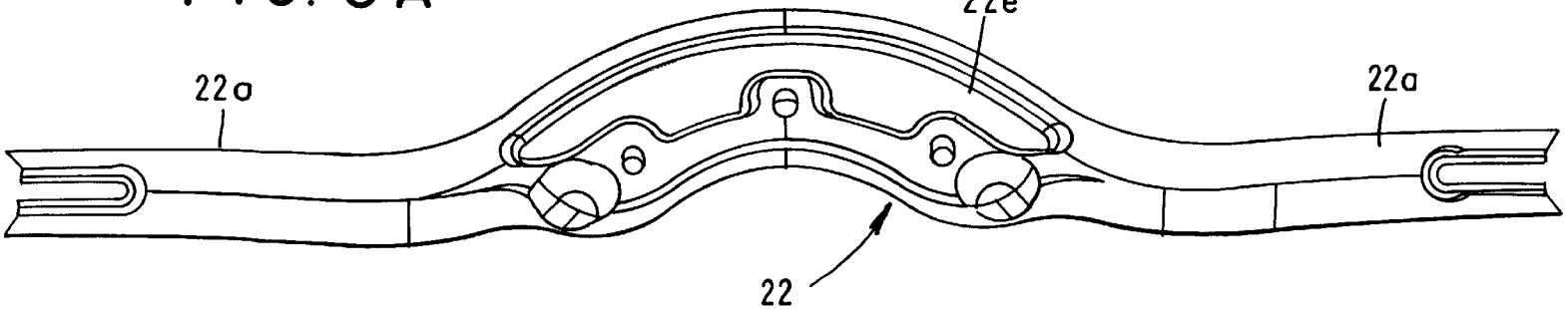
FIG. 8A is an enlarged top plan view of the yieldably deformable cross arm assembly of the invention.
Figure 10:
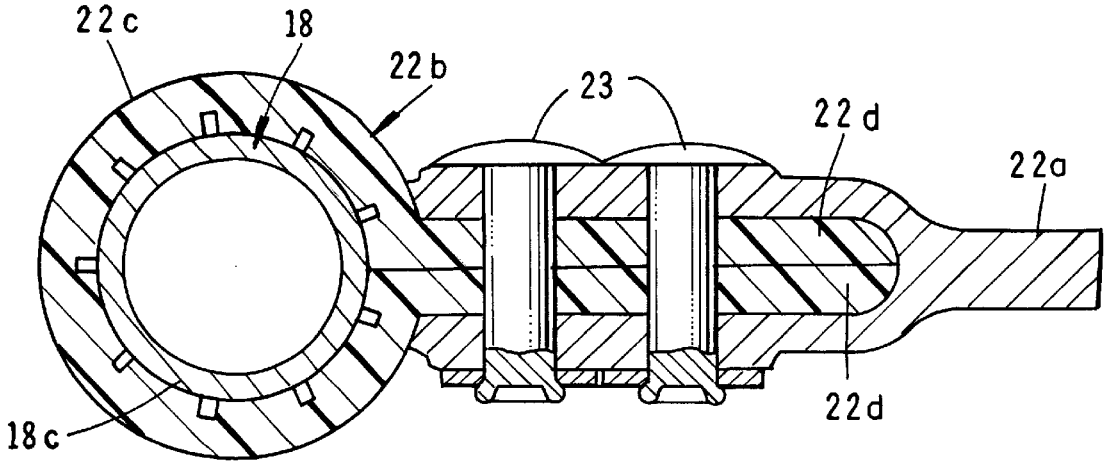
FIG. 10 is a greatly enlarged cross-sectional view taken along lines 10—10 of FIG. 2.
Figure 10A:
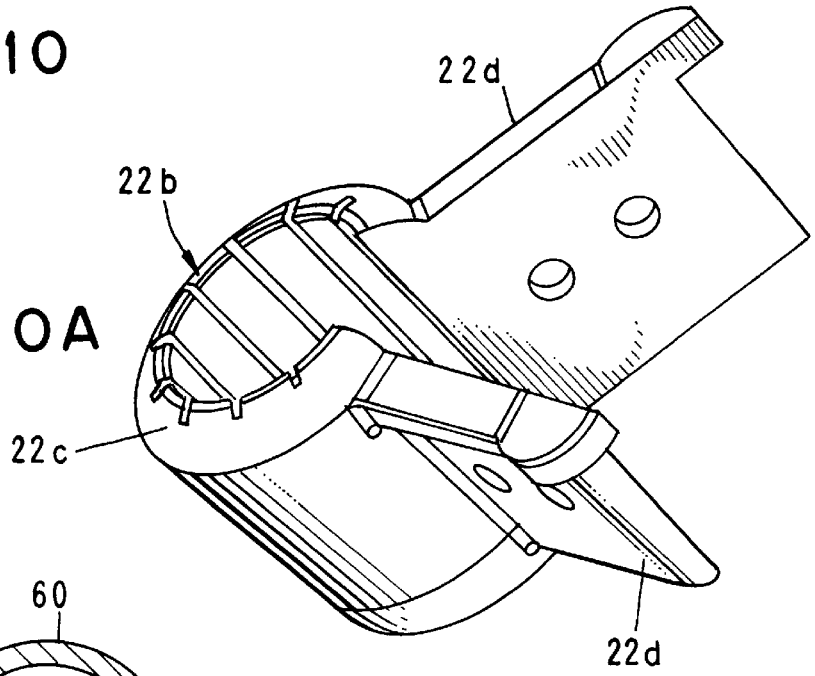
FIG. 10A is a generally perspective view of the connector collar depicted in FIG. 10, but shown in a relaxed, unassembled configuration.

Turning particularly to FIGS. 3, 5 and 8A, the chair construction of the present form of the invention can be seen to also include a transversely extending cross bar assembly 22 which comprises an elongated cross bar 22*a* having at either end thereof a leg connector assembly 22*b*.(FIG. 10) Connector assembly 22*b* includes a generally ring shaped, segmented portion 22*c* which circumscribes each of the legs 18 at an intermediate location 18*c*. Integrally formed with ring shaped portion 22*c* are outwardly extending, yieldably deformable wing like members 22*d*. Wing like members 22*d* initially extend angularly outwardly from ring shaped portion 22*b* in the manner shown in FIG. 10A, but when urged together in the manner shown in FIG. 5 can be interconnected with the end portions of cross bar 22 by a pair of connectors such as rivets 23. As the wing like end members 22*d* of the connector are urged together in the manner shown in the drawings, the segmented ring shaped portion 22*c* will close in a manner to pressurally engage and securely grip legs 18. This permits the connector assemblies to glide along legs 18 at their intermediate locations 18*c* as weight is placed on the seat of the chair. This coupled with the ability of the cross-bar itself to flex provides a shock-absorber effect as the user of the chair sits on the seat portion.

As best seen in FIG. 5, cross bar assembly 22 further includes a curved, generally plate like central portion 22*e* to which a generally triangular shaped base plate 26 is interconnected. Base plate 26, which is preferably constructed from a thin metal sheet, has a front edge portion 26*a* and angularly shaped rear portion 26*b* which is interconnected with portion 22*e* of cross bar assembly 22 by suitable fasteners 27 in the manner shown in FIG. 5. The angularly extending side portions of the base plate are suitably connected to rearwardly extending frame portions 17 as by spot welding.

Figure 7:
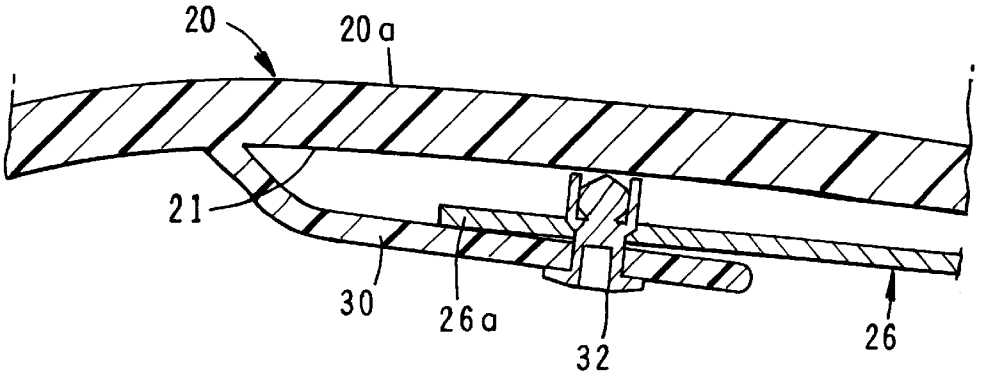
FIG. 7 is greatly enlarged cross-sectional view of the area designated in FIG. 6 by the numerals 7—7.

Forming an important aspect of the chair construction of the present invention is the previously mentioned molded plastic shell 20 which is secured to and supported by support frame 14. In the embodiment of the invention shown in the drawings, the molded shell includes the previously mentioned seat portion 20*a* as well as an integrally formed, upwardly extending back portion 20*b* which is provided with a finger grip opening 20*c* (FIG. 1). Referring particularly to FIGS. 5 and 7, it is to be noted that seat portion 20*a* includes a lower surface 21 which is provided with a transversely extending, integrally molded connector apron, 30. Connector apron 30 extends downwardly and rearwardly from the front edge of the seat portion of the molded shell so that it can be interconnected with base plate 26 by a plurality of transversely spaced apart connectors such as rivets 32.

Figure 4:
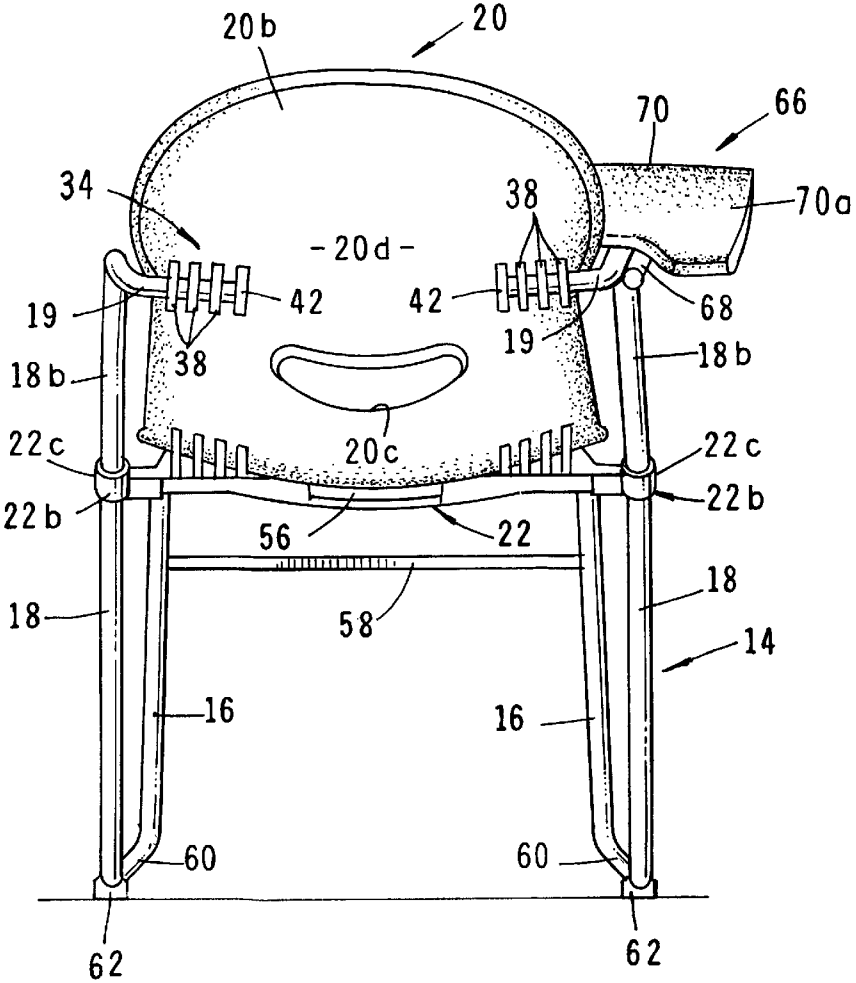
FIG. 4 is a rear view of the construction showing the manner in which the upper end portions of the chair arms are interconnected with the back of the molded plastic support shell.
Figure 12:
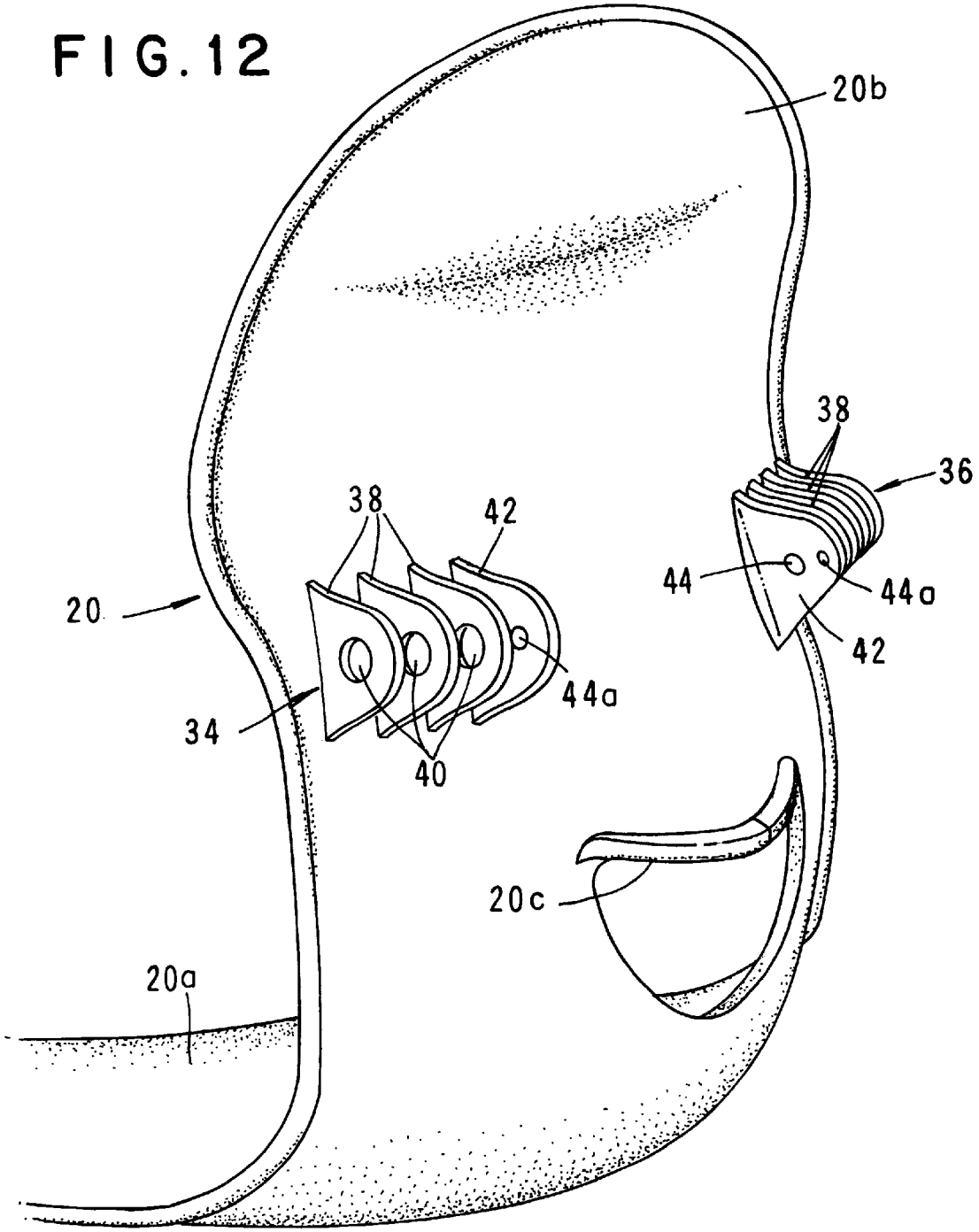
FIG. 12 is a generally perspective, rear view of a portion of the molded plastic shell portion of the chair of the present invention showing the integrally molded connector tabs to which the tubular supporting frame is connected.

A particularly unique aspect of the chair construction of the present inventions resides in the configuration of back portion 20*b* of molded shell 20. As shown in FIGS. 4 and 12, the rear surface 20*c* of back portion 20*b* is provided with first and second sets 34 and 36 of transversely spaced apart connector tabs 38. Connector tabs 38 are integrally formed with back portion 20*b* and extend outwardly from the rear surface 20*c* thereof in the manner best seen in FIG. 12. Each set of connector tabs includes three adjacent tabs 38, each of which is provided with a generally centrally located opening 40. (FIG. 12) Each set 34 and 36 of connector tabs also includes an inboard connector tab 42 which is provided with a reduced diameter aperture 44 the purpose of which will presently be described.

In accordance with the method of the invention, the integral polypropylene supporting shell 20 is molded by a conventional injection molding process which forms integral connector tab sets 34 and 36. During the molding step apertures 40 and 44 are formed in the connector tabs in a manner well understood by those skilled in the art. More particularly, apertures or openings 40 are strategically formed so that they will closely receive the inturned, transversely extending terminal portions 19 of legs 18. Portions 19 are securely connected with connector tab sets 34 and 36 in any suitable manner as, by way of example, using leg connector means of the character next to be described.

While various types of connector means can be used, in the present form of the invention, the leg connector means for interconnecting end portions 19 of rear legs 18 to connector tabs set 34 and 36 comprise two identical connector assemblies 45 of the construction shown in FIGS. 9, 9A, 9B, and 9C. More particularly, each connector assembly 45 comprises a connector element 46 (FIG. 9A) which in the manner shown in FIG. 9 is internally disposed within the open end portions of each of the inturned end portions 19 of each of the rear legs 18. As shown in FIG. 1A, each of the inturned end portions 19 is provided with a slot like opening 48 through which an outwardly extending locking protuberance 46*a* formed on each of the connector elements 46 lockably extends. Each inturned end portion 19 also includes an indexing notch-like opening 49 (FIGS. 1A and 9), which guidably receives an indexing protuberance 46*b* formed proximate the end of each of the connector elements 46 (FIG. 9A). Also forming a part of the leg connector means of the invention are connector assemblies 50. Each connector assembly 50 includes a bolt-like member 50*a*, the shank portion 51 of which is threadably receivable within slots 46*c* formed in each of the connector elements 46 (FIGS. 9 and 9A). Each threaded connector assembly 50 also includes a generally disk shaped head portion 52 (FIGS. 9B and 9C) which has a tapered, tab abutting surface 52*a* that is adapted to engage surfaces 42*a* of inboard connector tabs 42 of each of the connector tabs sets 34 and 36. Each head portion 52 is provided with an indexing protuberance 52*a* which is receivable in a strategically located aperture 44*a* provided in tabs 42 (FIG. 12).

In accordance with the method of the invention, back portion 20*b* of the plastic support shell 20 is interconnected with portions 19 of legs 18 of the support frame by first introducing each of the end portions 19 into openings 40 of each of the connector tab sets 34 and 36. Connector elements 46 are first inserted into the open ends of tubular portions 19 so that indexing protuberances 46*b* align with openings 49 and then the end portions are inserted into the connector tabs in the manner shown in FIG. 9. With this construction, when the connector elements seat within portions 19, protuberances 46*a* will align with slots 48 formed in the tubular portions 19. Next the bolt-like members 50*a* are threadably interconnected with connector elements 46 by rotation of members relative to each of the elements 46. As members 50*a* enter the slot like openings 46*c* of connector elements 46, they will expand the central portions of the elements outwardly so as to lockably force protuberance 46A into slots 48. Additionally, as the connectors 50 are cinched down, the tapered surfaces 52*a* of the head portions 52 will be brought into pressural engagement with surfaces 42*a* of each of the inboard tabs 42 of tab sets 34 and 36 (see also FIGS. 9B and 9C). With members 50*a* suitably cinched down against tabs 42 and with protuberances 46A locked into slots 48, portions 19 of the rear legs of the supporting frame will be securely interconnected with the outwardly extending connector tab sets 34 and 36 so as to support the molded shell in the proper position on the supporting frame 14.

Figure 6:
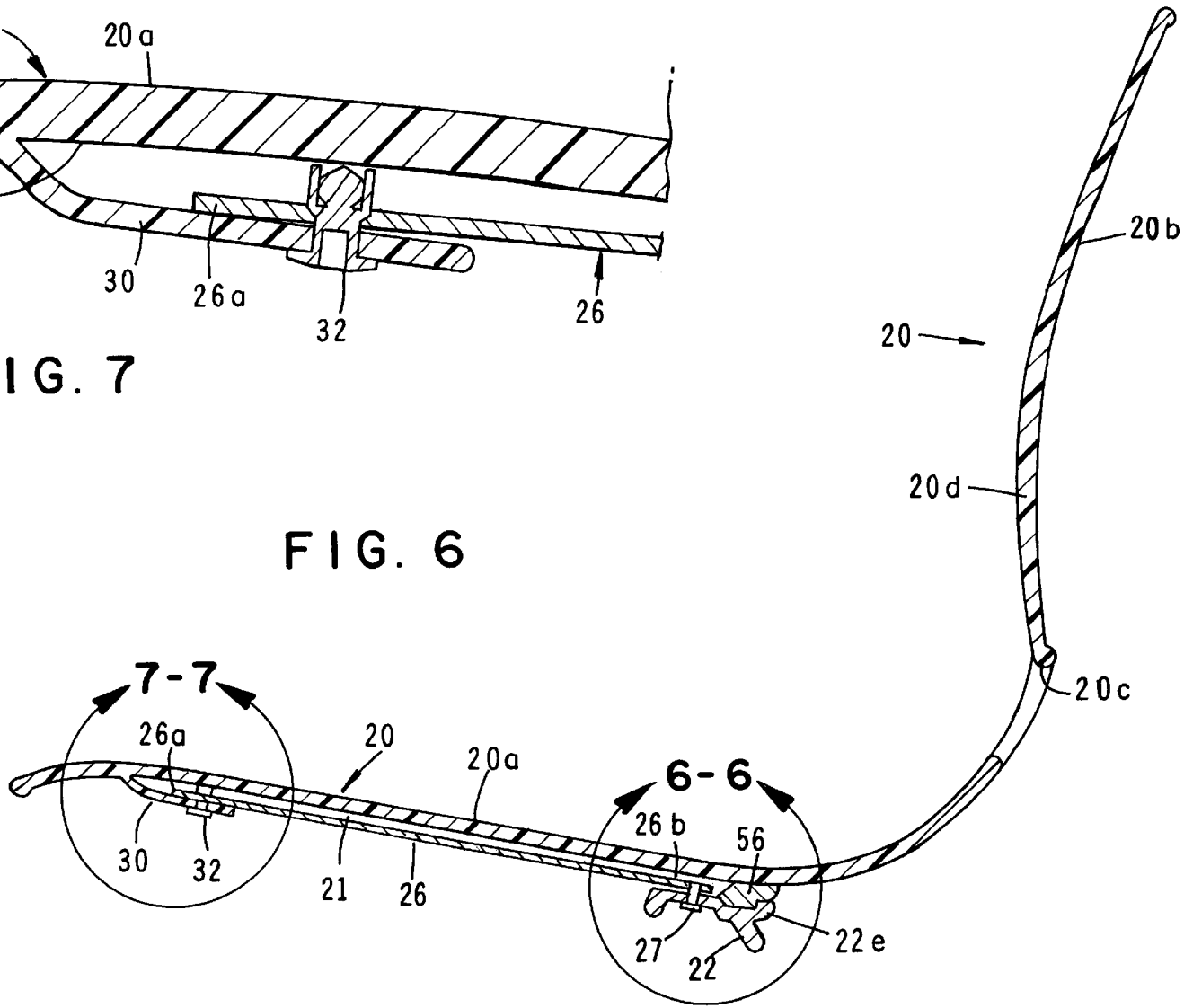
FIG. 6 is an enlarged cross-sectional view taken along lines 6—6 of FIG. 3.
Figure 8B:
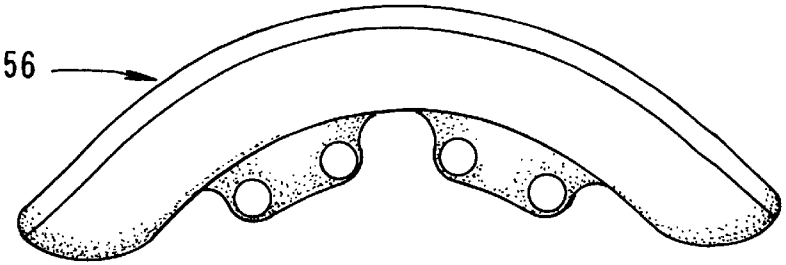
FIG. 8B is an enlarged top plan view of the bumper element of the apparatus.

As previously discussed, base plate 26 which is interconnected with support frame 14 in the manner shown in FIG. 1A is also connected to supporting shell 20 in the manner best seen FIGS. 6, 7, and 8. More particularly, the forward portion of support shell 20 is interconnected with base plate 26 by a plurality of connectors 32 which interconnect a downwardly curved, rearwardly extending apron 30 formed on the molded plastic shell with the forward edge 26*a* of the base plate (see also FIG. 5). As best seen in FIGS. 8, 8A, and 8B the rearward portion of seat 20*a* is uniquely, cushionably supported by flexible cross bar assembly 22 by a novel plastic bumper 56 and is securely interconnected with the angularly shaped rear portion 26*b* of plate 26 by a plurality of connectors 27. (See FIGS. 5,6 and 8). Bumper 56 is disposed intermediate cross-member assembly 22 and the bottom surface 21 of plastic support shell 20. With this novel construction, when the user of the chair sits on the seat portion of the support shell, cross-bar 22*a* will flex slightly and bumper 56 will tend to yieldably deform in a manner to provide a comfortable cushioning effect to the user. Additionally, as previously mentioned, segmented collars 22*c* of connector assemblies 22*b* will slide downwardly along legs 18 thereby providing a further cushioning effect. It is to be understood that bumper member 56 can be constructed of various yieldably, deformable materials such as plastic, rubber, and other elastomers, and preferably extends transversely of seat portion 20*a* by a distance approximating the width of the curved central portion 22*e* of cross bar assembly 22 (see FIG. 8B).

To provide additional rigidity to supporting frame 20, a transversely extending, front metal cross bar 58 is interconnected between front legs 16 in the manner best seen in FIG. 1. Providing still further structural integrity to the supporting frame 14 are ground engaging sled base members 60 which interconnect forward and rearward legs 16 and 18 of each side frame 14*a* and 14*b* in the manner best seen in FIGS. 1 and 1A. In the form of the invention shown in the drawings, ground engaging members 60 form an integral part of the strategically bent tubular support frame 14 which comprises the tubular sides 14*a* and 14*b*.

Figure 11:
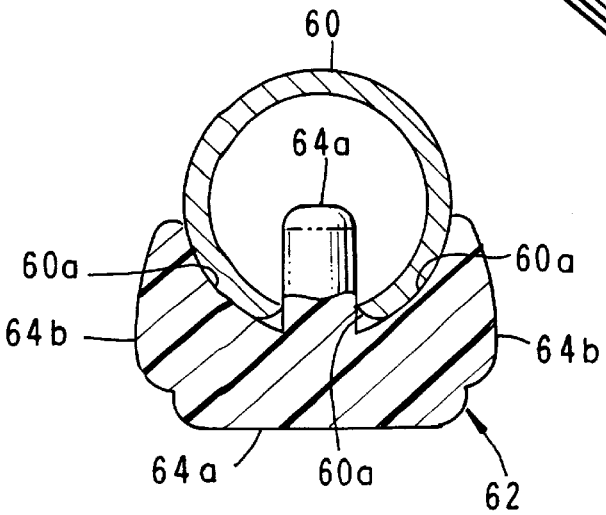
FIG. 11 is a greatly enlarged cross-sectional view taken along lines 11—11 of FIG. 2.

As shown in FIGS. 1 and 11, ground engaging shaped guides 62 are preferably provided on each of the ground engaging sled base members 60. For this purpose, each of the ground engaging members 60 is provided with a pair of longitudinally spaced apart openings 60*a* which closely receive an outwardly extending, tongue like portion 64*a* of a molded plastic guide 64. As best seen in FIG. 11, each of the body portion 64 of each of the glides includes a flat ground engaging surface 64*a* and a pair of transversely spaced apart side portions 64*b* which partially circumscribe the lower curved outer surfaces 60*a* of each of the ground engaging members 60. Members 64 can be molded from any suitable moldable plastic such as polycarbonate in a manner well known to those skilled in the art.

In the embodiment of the invention shown in FIG. 1 of the drawings, the chair construction also includes a tablet arm assembly 66. Tablet arm assembly 66 comprises a strategically bent tubular support member 68 having the end portion 68*a* thereof affixed to upper portion 18*b* of a selected one of the rear legs 18 (see FIG. 1B). Member 68 also includes an intermediate portion 68*b* which is interconnected to a tablet member 70 by means of a pair of generally "U" shaped brackets 72 allowing the tablet arm to articulate allowing for ease of entry and exit and allowing chairs to be stacked (FIG. 5). In the drawings tablet arm assembly 66 is shown interconnected with the right side frame of the tubular support structure and presents a smooth, slightly angularly upwardly extending writing surface 70*a* which can be used by a student for supporting work papers and the like. It is to be understood that a similarly constructed tablet arm assembly could be affixed to the left hand side of the frame for use by left handed students. Tablet 70 can be constructed of a variety of materials, but preferably comprises a particle board core to which top and bottom plastic sheets are connected to provide a smooth writing surface 70*a*.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

We claim:

1. A chair comprising:

(a) a supporting frame having a pair of interconnected sides, each said side having:
  (i) a front leg; and
  (ii) a rear leg having an inturned end portion; and (b) a seat structure supported by said supporting frame, said seat structure having a seat portion and a back portion, said back portion having a plurality of integrally formed, spaced-apart connector tabs extending therefrom, at least two of said connector tabs having openings formed therein; and (c) connector means for interconnecting said inturned end portions of said rear legs of said supporting frame with said connector tabs, said connector means comprising:

(i) a connector element connected to each of said inturned end portions of said rear legs; and (ii) a pair of connector assemblies each including a member having a shank portion connected to one of said connector elements and a head portion, said head portion having a surface in engagement with one of said connector tabs.

2. A chair as defined in claim 1 in which said inturned end portion of each of said rear legs is tubular in shape and in which said connector elements are disposed interiorly of said inturned end portions of said rear legs.

3. A chair as defined in claim 2 in which each said shank portions of said members of said connector assemblies are externally threaded for threadable interconnection with said connector elements.

4. A chair as defined in claim 3 in which each said head portion of said connector assemblies comprises a generally disk shaped member having a sloping tab abutting surface for engagement of said connector tabs.

5. A chair comprising:

(a) a supporting frame having first and second sides, each side including:

(i) a front leg having a lower extremity and an upper extremity, said upper extremity having an inturned, rearwardly extending portion; and (ii) a generally tubular rear leg having a lower extremity an intermediate portion, and an upper extremity, said upper extremity having an inturned transversely extending portion;

(b) a seat shell supported by said supporting frame, said seat shell having:

(i) a seat portion having a lower surface; and (ii) a back having a rear surface including first and second sets of connector tabs, each said first and second set of connector tabs including a plurality of connector tabs extending from said rear surface, said first set having a connector tab provided with an opening for receiving said inturned, transversely extending portion of said rear leg of said first side and said second set having a connector tab provided with an opening for receiving said inturned, transversely extending portion of said rear leg of said second side; and (c) leg connector means for interconnecting said inturned, transversely extending portions of said rear legs of said supporting frame with said connector tabs, said leg connector means comprising a connector element disposed interiorly of each said inturned end portions of each of said rear legs.

6. A chair as defined in claim 5 in which each said inturned end portion of each of said rear legs is provided with a slot and in which each said connector element includes a protuberance closely receivable within said slot.

7. A chair as defined as in claim 6 in which said leg connector means further comprises threaded members interconnected with said connector elements, each said threaded member having a generally disk shaped head including a tab abutting surface for engaging one of said connector tabs.

8. A chair as defined in claim 7 in which each said first and second sets of connector tabs includes an inboard connector tab and an outboard connector tab, said disk shaped head member of said threaded connector engaging said inboard connector tabs and said outboard connector tabs having an opening for receiving said inturned transversely extending portions of said rear legs.

* * * * *